US006752110B2

(12) United States Patent
Tharman et al.

(10) Patent No.: US 6,752,110 B2
(45) Date of Patent: Jun. 22, 2004

(54) ELECTROMECHANICAL CHOKE SYSTEM FOR AN INTERNAL COMBUSTION ENGINE

(75) Inventors: Paul A. Tharman, Pewaukee, WI (US); Curtis L. Schultz, Grafton, WI (US); Jeffrey C. Blonski, Racine, WI (US); Thomas G. Guntly, Hartford, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/251,382

(22) Filed: Sep. 20, 2002

(65) Prior Publication Data

US 2004/0055554 A1 Mar. 25, 2004

(51) Int. Cl.[7] ..... F02M 1/10
(52) U.S. Cl. ..... 123/179.18
(58) Field of Search ..... 123/179.18, 438, 123/179.26; 261/39.1; 56/10.5; 335/272

(56) References Cited

U.S. PATENT DOCUMENTS

| | | | |
|---|---|---|---|
| 1,515,830 | A | 11/1924 | Burchett |
| 1,528,484 | A | 3/1925 | Holley |
| 1,534,742 | A | 4/1925 | Short et al. |

(List continued on next page.)

OTHER PUBLICATIONS

"Commercial Redi–Temps." Data sheet [on line]. Elmwood Sensors, Inc. [retrieved on Jun. 4, 2002]. <http://www.elmwoodsensors.com/prol.htm>.

"Commercial Products for Thermal Sensing and Control Applications." Data sheet [on line]. Elmwood Sensors, Inc. [retrieved on Jun. 4, 2002]. <http://elmwoodsensors.com/products.htm>.

"Commercial Bimetal Thermostats Model 3455RC." Data sheet [on line]. Elmwood Sensors, Inc. [retrieved on Jun. 4, 2002]. <http://elmwoodsensors.com/bimetal.htm>.

*Primary Examiner*—Andrew M. Dolinar
(74) *Attorney, Agent, or Firm*—Michael Best & Friedrich, LLP

(57) ABSTRACT

An engine starting system for an internal combustion engine. The starting system includes a starter switch electrically connected between a battery and a starter motor for the engine, and a choke valve disposed in an air intake of an air/fuel-mixing device for the engine. The choke valve moves in response to a solenoid actuator. The solenoid actuator is electrically connected to the starter motor and a temperature switch. When starting the engine below a threshold temperature, the starter switch and temperature switch close such that the battery powers the starter motor and solenoid actuator. The energized solenoid actuator moves the choke valve to a closed position to enrich the air/fuel mixture. Above a certain threshold temperature, the temperature switch interrupts the power to the solenoid actuator.

14 Claims, 2 Drawing Sheets

U.S. PATENT DOCUMENTS 1,577,765 A 3/1926 Sisson
1,577,766 A 3/1926 Sisson
1,907,351 A 5/1933 King et al.
1,994,807 A 3/1935 Blake et al.
1,995,145 A 3/1935 Frost
2,969,785 A 1/1961 Fuchs et al.
3,534,720 A 10/1970 DuBois
3,608,533 A 9/1971 Mennesson
3,948,240 A 4/1976 Hirosawa et al.
3,960,130 A 6/1976 Peterson, Jr.
4,005,690 A 2/1977 Hirosawa et al.
4,027,640 A 6/1977 Hirosawa et al.
4,031,872 A 6/1977 Thompson et al.
4,084,559 A 4/1978 Wallbaum
4,093,931 A * 6/1978 Fenton ..... 335/272
4,193,384 A 3/1980 Steiner et al.
4,373,479 A 2/1983 Billingsley et al.
4,474,009 A 10/1984 Fried et al.
4,475,502 A 10/1984 Matsumoto
4,523,561 A 6/1985 Kosuge
4,768,478 A 9/1988 Martel
5,092,301 A 3/1992 Ostdiek
5,121,719 A 6/1992 Okazaki et al.
5,158,051 A 10/1992 Wada et al.
5,511,519 A 4/1996 Watson et al.
5,537,964 A 7/1996 Hoshiba
5,611,312 A 3/1997 Swanson et al.
5,660,765 A 8/1997 King et al.
5,676,102 A 10/1997 Ichinose et al.
5,827,455 A 10/1998 Nakai
5,832,888 A 11/1998 Griffiths et al.

* cited by examiner

ELECTROMECHANICAL CHOKE SYSTEM FOR AN INTERNAL COMBUSTION ENGINE

BACKGROUND OF THE INVENTION

The present invention relates to an engine starting system for an internal combustion engine. More particularly, the invention relates to an automatic choke system for a small engine.

Internal combustion engines often include a system or mechanism to regulate the air/fuel mixture to the engine based on engine temperature conditions. A choke valve typically regulates the airflow to the engine. For cold engine temperature conditions, such as when initially starting an engine, the choke valve reduces the airflow to the engine to enrich the air/fuel mixture. For higher temperature conditions, such as after normal engine operation (e.g. for a hot restart of the engine), the choke valve is not needed because the engine no longer requires a rich air/fuel mixture.

SUMMARY OF THE INVENTION

In one embodiment, the invention provides an engine starting system that includes a battery, a starter motor, a starter switch, a solenoid actuator, a choke valve, and a temperature switch. The starter switch is electrically connected between the battery and the starter motor for the engine. The choke valve is disposed in an air intake of an air/fuel-mixing device for the engine. The choke valve interconnects with and moves in response to the solenoid actuator. The solenoid actuator is electrically connected to the starter switch and the temperature switch. Above a certain threshold temperature, the temperature switch interrupts the power supplied to the solenoid actuator. If the power to the solenoid is interrupted, a bias spring connected to the solenoid actuator moves the choke valve to an open position.

In another embodiment, the engine starting system further includes a time delay electrically connected to the solenoid. The time delay energizes the solenoid actuator for an extended period of time after the starter switch closes. In yet another embodiment, the engine starting system further includes a free wheeling diode electrically connected between the positive and negative terminals of the solenoid actuator. After electrical power is interrupted to the solenoid actuator, the free wheeling diode re-circulates and dissipates the electrical current of the solenoid actuator.

In a small engine application, the invention regulates the air intake of an air/fuel-mixing device based on starter motor activation and temperature conditions. Electrically connecting a solenoid actuator between a temperature switch and starter switch provides an economical means for regulating the open position of a choke valve when powering a starter motor at hot versus cold temperatures.

As is apparent from the above, the invention provides an engine starting system that regulates the intake of air to the air/fuel-mixing-device of an engine based on temperature. Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
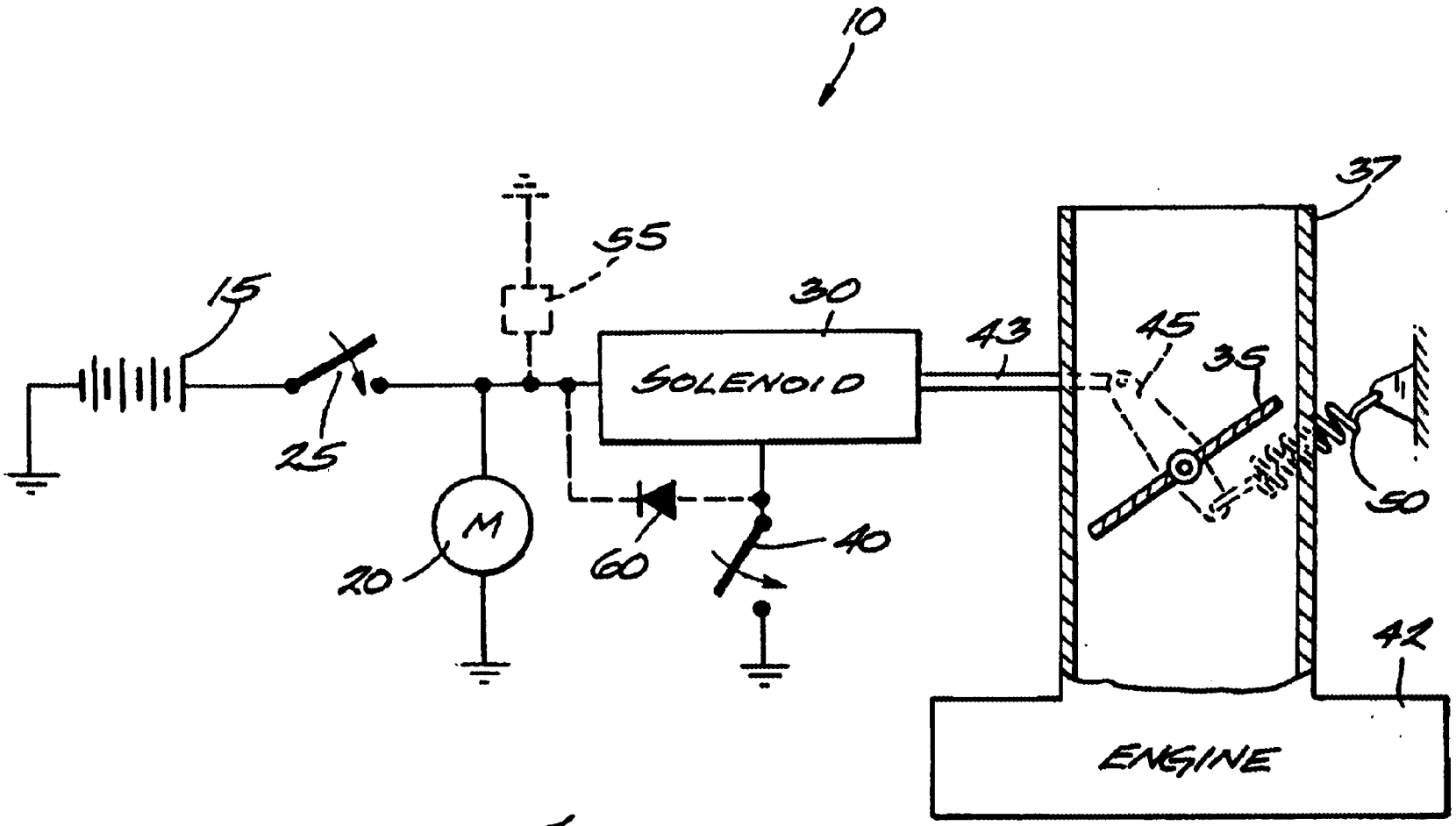
FIG. 1 is a schematic diagram of an exemplary engine starting system embodying the invention.

Referring to the drawings, FIG. 1 illustrates an exemplary embodiment of an engine starting system 10 embodying the invention. The system includes a battery 15, a starter motor 20, a starter switch 25, a solenoid actuator 30, a choke valve 35 disposed in an air intake 37 to an air/fuel-mixing device (not shown), and a temperature switch 40.

The starter switch 25 is electrically connected between the battery 15 and a positive terminal of the starter motor 20 for an engine 42. The negative terminal of the starter motor 20 is electrically connected to electrical ground. When an operator activates the starter to the engine 42 (e.g., pushes starter button, turns the ignition key), the starter switch 25 closes enabling the battery 15 to provide power to the starter motor 20. An exemplary battery 15 is a 12-volt DC battery suitable to energize the motor 20. Upon receiving power, the starter motor 20 cranks the engine 42 to start. When the operator disengages the starter (not shown), the starter switch 25 opens and interrupts the electrical power to the starter motor 20.

Figure 2:
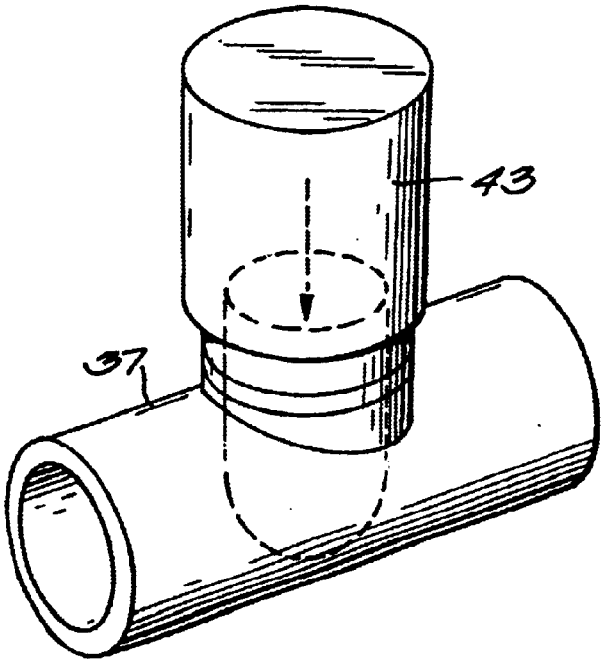
FIG. 2 is a schematic diagram of an exemplary solenoid actuator directly regulating the intake of air to the air/fuel-mixing device.

The positive terminal of the starter motor 20 is also electrically connected to the positive terminal of the solenoid actuator 30. The negative terminal of the solenoid actuator 30 is electrically connected to a temperature switch 40 (discussed below). When starting the engine 42, the starter switch 25 closes enabling the battery 15 to provide power to the solenoid actuator 30. When energized, the solenoid actuator 30 moves the choke valve 35 to a closed position (discussed below). FIG. 1 shows an exemplary solenoid actuator 30 that includes a linear actuator 43. The linear actuator 43 is connected by a linkage 45 to the choke valve 35 located in the intake 37 of air/fuel-mixing device. In the exemplary embodiment, the linkage 45 pivotally connects to the choke valve 35 using any suitable means (e.g., pin, hinge, bolt, etc.). In another embodiment, the linear actuator 30 can be directly connected the choke valve 35 using a suitable pivotal connection means known in the art. In yet another embodiment as shown in FIG. 2, the direct movement of the solenoid actuator 30 can control the intake of air to the air/fuel-mixing device. In this embodiment, the choke valve 35 and its connecting means to the solenoid actuator 30 can be removed. In place of the choke valve 35, the rod of the solenoid actuator 30 and/or air intake is sized such that the rod spans the diameter of air intake 37 to the air/fuel-mixing. Thereby, the rod acts as the choke valve 35 in regulating the intake of air to the air/fuel-mixing device.

Figure 3:
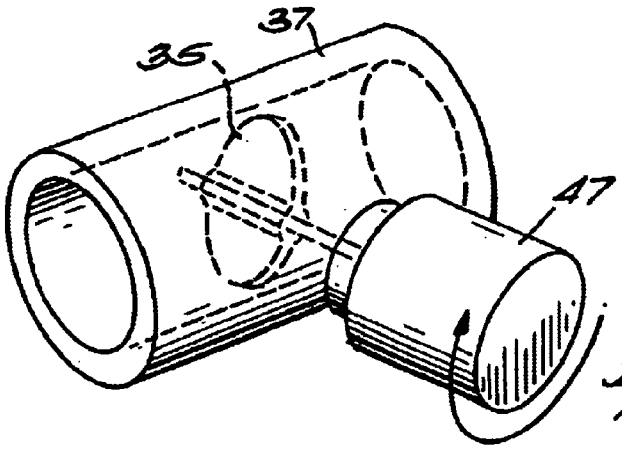
FIG. 3 is a schematic diagram of an exemplary solenoid actuator that includes a rotary actuator connected to the choke valve.

In another embodiment as shown in FIG. 3, the solenoid actuator 30 can include a rotary actuator 47 directly connected the choke valve 35. In this embodiment, a fixed connecting means (e.g., spot weld, screw, etc.) can be used to connect the solenoid actuator to the choke valve 35. Of course, other suitable types of solenoid actuators or DC machines known in the art can be used to move the choke valve 35.

Additionally, a spring return 50 is connected to the choke valve 35 to bias the choke valve 35 toward a closed position. Alternatively, the solenoid actuator 30 can include a spring return to bias the choke valve 35 to an open position.

As noted above, the choke valve 35 interconnects with and moves in response to the solenoid actuator 30. The choke valve 35 is normally positioned in the intake of an air/fuel-mixing device for the engine 42. The choke valve 35 regulates the intake of air to the air/fuel-mixing device, thereby regulating the air/fuel ratio. FIG. 1 shows an exemplary choke valve 35 that includes a gate valve. Other suitable types of choke valves 35 known to those in the art can be used as well.

Figure 4:
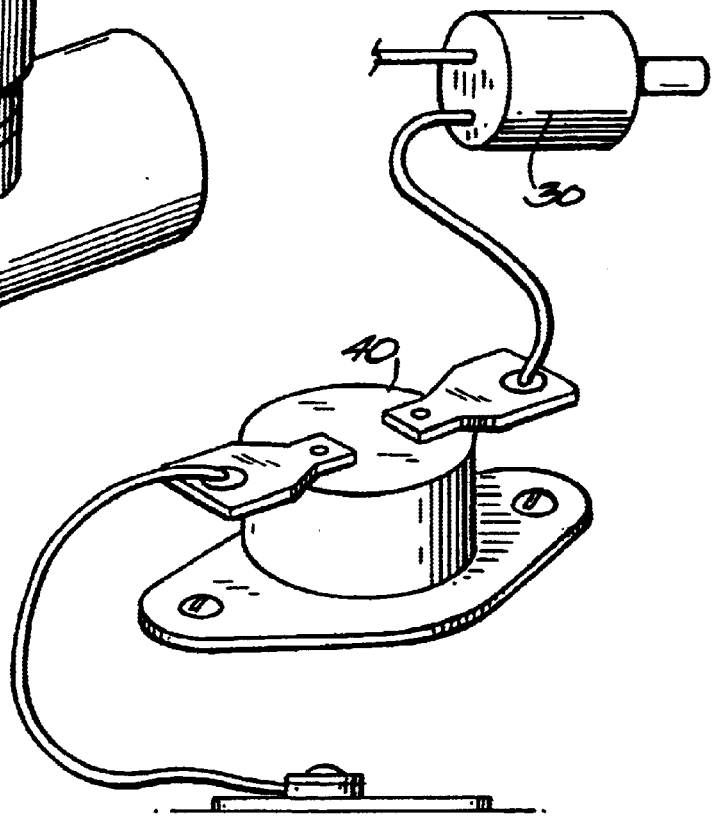
FIG. 4 is a schematic diagram of an exemplary temperature switch electrically connected to the solenoid actuator.

The temperature switch 40 is electrically connected to the solenoid actuator 30 as shown in FIG. 1. Above a certain threshold temperature, the temperature switch 40 interrupts the electrical power supplied to the solenoid actuator 30. As shown in FIG. 4, the solenoid actuator 30 includes positive and negative electrical terminals. The positive terminal of the solenoid actuator 30 receives electrical power from the battery 15 via the electrical connection with the starter switch 25. The negative terminal of the actuator 30 is electrically connected to one terminal of the temperature switch 40. The other terminal of the temperature switch 40 is electrically connected to electrical ground. The temperature switch 40 is mounted in a suitable location on or near the engine 42 (e.g., the exhaust port, the engine housing, etc.) to provide a measure of the temperature. The temperature switch 40 can be mounted using any suitable means (e.g., bolt, screw, spot-weld, adhesive, etc.) known to those in the art. An exemplary temperature switch 40 is an Elmwood™ sensor Part No. 3455RC. Other suitable types of temperature switches 40 known to those in the art can be used as well.

In another embodiment as shown in FIG. 1, the system 10 can include an electronic time delay 55 (shown in dashed lines). The time delay 55 is electrically connected to provide electrical power to the solenoid actuator 30 for a delay time period (e.g., about 5 seconds after cranking the starter) before de-energizing the actuator 30 and opening the choke valve 35. Thereby, the solenoid actuator 30 is energized to hold the choke in a closed position for an extended time period beyond the opening of the starter switch 25. Any suitable electronic time delay 55 known in the art can be used (e.g., delay circuit, capacitor, etc.).

In yet another embodiment as shown in FIG. 1, the system 10 can include a free-wheeling diode 60 (shown in dashed lines) electrically connected between the positive and negative terminals of the solenoid actuator 30. The free-wheeling diode 60 allows current to re-circulate and dissipate after the electrical power is interrupted to the solenoid actuator 30. Thereby, the solenoid actuator 30 more readily responds to an opening of the starter switch 25 or temperature switch 40. Any suitable freewheeling diode 60 known in the art can be used.

In typical operation, an operator engages the electrical starter that closes the starter switch 25 to start the engine 42. When the starter switch 25 is closed, the battery 15 supplies power to the starter motor 20 and the solenoid actuator 30. If the temperature of the engine 42 is below a certain threshold temperature, the temperature switch 40 closes the circuit with the battery 15 to energize the solenoid actuator 30. The energized solenoid actuator 30 moves the choke valve 35 to a closed position to reduce the airflow to the engine and thereby enrich the air/fuel mixture. If the engine temperature is above a certain threshold temperature, the temperature switch 40 opens. An example when this temperature condition can occur is after normal operation of the engine. Above the threshold temperature, the rich air/fuel mixture is not needed by the engine. The open temperature switch 40 opens and interrupts the electrical power to the solenoid actuator 30. Upon interruption of electrical power, the solenoid actuator 30 de-energizes and the spring 45 biases the choke valve 35 to an open position. After starting the engine 42, the starter switch 25 opens and interrupts the power from the battery 15 to the starter motor 20 and the solenoid actuator 30. Again, once the engine starts, a rich air/fuel-mixture is not needed by the engine 42, so the solenoid actuator 30 is not energized to move the choke valve 35 to the closed position. As a result, the spring 50 biases the choke valve 35 to an open position.

Thus, the invention provides, among other things, an exemplary engine starting system 10 that regulates the intake of air to the air/fuel-mixing system. Various features and advantages of the invention are set forth in the following claims.

What is claimed is:

1. An engine starting system, comprising:

a battery:

a starter motor powered by said battery, the starter motor including a positive terminal and a negative terminal;

a starter switch electrically connected between the battery and the starter motor;

a solenoid actuator powered by said battery and directly electrically connected to the positive terminal of the starter motor;

a choke valve disposed in an air intake of an air/fuel-mixing device, the choke valve interconnected with and movable in response to the solenoid actuator;

a temperature switch electrically connected to the negative terminal of the solenoid actuator, wherein the temperature switch interrupts the electrical power supplied to the solenoid actuator above a threshold temperature; and a delay switch electrically connected to the positive terminal of the solenoid actuator, wherein the delay switch provides electrical power for a selected period of time to the solenoid actuator after the starter switch moves from a closed to an open position.

2. The engine starting system as claimed in claim 1, wherein the solenoid actuator includes a rotary actuator.

3. The engine starting system as claimed in claim 1, wherein the solenoid actuator includes a linear actuator.

4. The engine starting system as claimed in claim 3, further comprising:

a linkage that couples the linear actuator to the choke valve.

5. The engine starting system as claimed in claim 1, further comprising:

a spring that biases the solenoid actuator to move the choke valve to a substantially open position.

6. The engine starting system as claimed in claim 1, further comprising:

a free-wheeling diode electrically connected between the positive and negative terminals of the solenoid actuator.

7. The engine starting system as claimed in claim 1, wherein the starter motor is used to start a lawnmower engine.

8. An engine starting system, comprising:

a battery;

a starter motor powered by said battery, the starter motor including a positive terminal and a negative terminal;

a starter switch electrically connected between the battery and the starter motor;

a solenoid actuator powered by said battery and directly electrically connected to the positive terminal of the starter motor;

a choke valve disposed in an air intake of an air/fuel-mixing device, the choke valve interconnected with and movable in response to the solenoid actuator;

a temperature switch electrically connected to the negative terminal of the solenoid actuator, wherein the temperature switch interrupts the electrical power supplied to the solenoid actuator above a threshold temperature; and a free-wheeling diode electrically connected between the positive and negative terminals of the solenoid actuator.

9. The engine starting system as claimed in claim 8, wherein the solenoid actuator includes a rotary actuator.

10. The engine starting system as claimed in claim 8, wherein the solenoid actuator includes a linear actuator.

11. The engine starting system as claimed in claim 10, further comprising:

a linkage that couples the linear actuator to the choke valve.

12. The engine starting system as claimed in claim 8, further comprising:

a spring that biases the solenoid actuator to move the choke valve to a substantially open position.

13. The engine starting system as claimed in claim 8, wherein the starter motor is used to start a lawnmower engine.

14. The engine starting system as claimed in claim 8 further comprising:

a delay switch electrically connected to the positive terminal of the solenoid actuator, wherein the delay switch provides electrical power for a selected period of time to the solenoid actuator after the starter switch moves from a closed to an open position.

* * * * *